US005439359A

United States Patent [19]

Leroy et al.

[11] Patent Number: 5,439,359

[45] Date of Patent: Aug. 8, 1995

[54] ROTARY POSITIVE DISPLACEMENT MACHINE WITH HELICOID SURFACES OF PARTICULAR SHAPES

[76] Inventors: Andre Leroy, 64 Chaussee de Binche, B 7030 Mons, Belgium; Jean M. Flamme, 23 Boulevard Richard Lenoir, F 75011 Paris, France

[21] Appl. No.: 211,713

[22] PCT Filed: Oct. 15, 1992

[86] PCT No.: PCT/FR92/01010

§ 371 Date: Apr. 22, 1994

§ 102(e) Date: Apr. 22, 1994

[87] PCT Pub. No.: WO93/08402

PCT Pub. Date: Apr. 29, 1993

[30] Foreign Application Priority Data

Oct. 23, 1991 [FR] France ..... 91 13530

[51] Int. Cl.[6] ..... F01C 1/10

[52] U.S. Cl. ..... 418/48; 418/150

[58] Field of Search ..... 418/48, 150

[56] References Cited

U.S. PATENT DOCUMENTS 2,525,265 10/1950 Moineau ..... 418/150
3,168,049 2/1965 Taylor et al. ..... 418/48
3,208,391 9/1965 Lindberg ..... 418/150
3,975,120 8/1976 Tschirky .
4,482,305 11/1984 Natkai et al. ..... 418/150
4,692,105 9/1987 Leroy .
4,773,834 9/1988 Saruwatari ..... 418/150

FOREIGN PATENT DOCUMENTS 997957 1/1952 France .

*Primary Examiner*—Richard A. Bertsch
*Assistant Examiner*—Charles G. Freay
*Attorney, Agent, or Firm*—Kerkam, Stowell, Kondracki, & Clarke; William L. Feeney

[57] ABSTRACT

A rotary positive displacement machine is formed by a male organ and a female organ that surrounds it. The male and female organs have helicoid surfaces of particular shapes and also have parallel axes. The male and female surfaces of the invention define a work chamber and the machine has $n_m+1$ permanently existing points of contact between the male and female profiles. Furthermore, the work chambers of the machine are closed such that the male and female surfaces defining the chambers contain a single point defining a tapered closure in a section where the closure point comes into contact with the $n_m+1$ permanently existing points of contact.

7 Claims, 15 Drawing Sheets

PRIOR ART

ROTARY POSITIVE DISPLACEMENT MACHINE WITH HELICOID SURFACES OF PARTICULAR SHAPES

The invention relates to a positive displacement machine which is formed by a male organ and a female organ (tubular body) that surrounds it.

In this machine, the outer surface of the male organ, which will be called the male surface, and the inner surface of the female organ, which will be called the female surface, are helicoidal surfaces whose axes are parallel and are spaced apart from one another by a length that will be designated as E.

These surfaces are defined about these axes by the nominal profile that they have in any section perpendicular to the axes (cross section) and by their respective pitches $P_m$ and $P_f$.

The delimitation of the volume of the work chambers of the machine and the axial progression of these chambers, which characterizes this type of mechanism when $P_m$ and $P_f$ are finite, result from the fundamentally linear contacts between the male surface and the female surface; the relative motion of these two surfaces displaces these linear contacts spatially.

In the machines in question here, the directrix of the male surface, which will be called the male profile, has an order of symmetry $n_m$ about its center, which is the point $O_m$ of the axis of the male surface in the plane of the profile. This profile is inscribed in the circular ring with a center $O_m$, of width 2E and having a mean radius $R^\circ_m$ (ring containing the male profile).

The directrix of the female surface, which will be called the female profile, has an order of symmetry $(n_m+1)$ about its center, which is the point $O_f$ of the axis of the female surface in the plane of the profile. This profile is inscribed in the circular ring having the center $O_f$, the width 2E, and the mean radius $R^\circ_f = R^\circ_m + E$ (ring containing the female profile).

The mean radius $R^\circ_m$ may be considered as the parameter that determines the scale of the cross section of the mechanism, and the parameter E may be considered as a parameter of shape.

The ratio between the pitches of the male and female surfaces is determined by the orders of symmetry of the profiles, in accordance with the equation $P_f/P_m = (n_m+1)/n_m$.

In the machines in question, the male organ is in planetary motion relative to the female organ. The first rotation of this planetary motion drives the axis of the male surface, at an arbitrary speed $\omega$, to make this axis describe a cylinder of revolution having a radius E about the axis of the female surface. The second rotation composing the relative planetary motion drives the male organ to make it rotate about the axis of the male surface at the speed $(-\omega/n_m)$.

Finally, when $P_m$ and $P_f$ are finite, the fluid with which the machine exchanges energy can be admitted via a cross section at the end of the mechanism and can escape via its other end, without requiring any distribution contrivance.

The known machines that meet this description, (such as French Patent FR-A-997957 of Moineau, other previous Moineau patents, and U.S. Pat. No. 3,975,120 Tschirky) in which $P_m$ and $P_f$ are finite, are used in particular as downhole motors in petroleum, gas or geothermal drilling, where their slender cylindrical external shape is of direct benefit. In these motors, the female organ most often belongs to the stator, while the planetary motion of the male organ relative to this female organ is accordingly identified with its absolute motion. The male and female profiles of the helicoidal surfaces used in these machines are described by W. Tiraspolsky, in *Les moteurs de fond hydrauliques, cours de forage* (Hydraulic Downhole Motors in Drilling), pp. 258 and 259, published by Editions TECHNIP, Paris 15; the male profile is considered to be the curve at a uniform distance D from the ordinary trochoid having an order of symmetry $n_m$, and the female profile of mean radius $R^\circ m+E$ is considered to be the curve at the same uniform distance D from the ordinary trochoid having the order of symmetry $(n_m+1)$.

If the curves at a uniform distance from the ordinary trochoids were strictly physically embodied, then these two profiles would permanently have $(n_m+1)$ points of contact, and as they periodically come into coincidence along the circular arcs of radius D centered on the cusps of the ordinary trochoids, would make it possible to permanently isolate the work chambers via the contacts between the male and female surfaces.

Unfortunately, the curves at a uniform distance from any ordinary trochoid always have cusps and accordingly cannot be strictly physically embodied; knowingly or unknowingly, male and female profiles are then manufactured with their cusps amputated, and the consequences are that these approximate profiles have slight angular points, but above all are not rigorously conjugated over their entire perimeter, and so in principle they are useless for constituting a mechanism where the contact surfaces are rigid. This difficulty is overcome as follows: the female profile is formed in an elastomer composition in which the local deformations prevent fluid leakage or interference of the profiles. Nevertheless, these parasitic deformations cause major organic losses and very hard operation of the machine, which limits its use to cases where there is no substitute for it.

SUMMARY OF THE INVENTION

The machines according to the invention eliminate these disadvantages by proposing male and female profiles whose association has novel or unexploited properties.

In the machines that are the subject of the invention, the male profile possesses the following properties:

- it has an order of symmetry $n_m$ with respect to its center $O_m$ and a symmetry with respect to the axis originating in $O_m$ passing through the extreme polar radius points, these polar radii being determined with respect to $O_m$,
- between two successive extreme polar radii, a running point U which traverses the profile from the point of maximum polar radius ($R_{max}$) to the point of minimum polar radius ($R_{min}$) determines a polar radius whose decrease is monotonous,
- in its traversal defined above, the running point U passes via a fixed point A on the profile, whose polar radius $R_{A0}$, its first derivative $R_{A1}$ with respect to the polar angle, and its second derivative $R_{A2}$ with respect to the polar angle satisfy the following two conditions:

$$n_m E = R_{A0} \cdot \sin\{arc\tan(-R_{A1}/R_{A0})\}$$

$$R_{A2}/R_{A0} = -(R_{A1}/R_{A0})^4$$

where $$R_{max}-R_{min}=2E.$$

These analytical conditions are involved by the following two geometrical properties of the male profiles used in the machines according to the invention:

the normal $g_A$ to the male profile at A is tangent to the circumference $C_{pm}$, centered on $O_m$, of radius $n_mE$, at a point $A_1 \equiv A_2$, the normal $g_U$ at any running point U different from A intersects the circumference $C_{pm}$ at two real, separate points $U_1$ and $U_2$.

In the machines that are the subject of the invention, where $P_m$ and $P_f$ are finite, the female profile is identified with the complete physically embodiable outer envelope of a male profile meeting the above conditions in its relative planetary motion.

It may be noted that with the definition of the male profile of the machines that are the subject of the invention, $(n_m+1)$ points of contact permanently exist between the male and female profiles. Such points will be called driving points. These points traverse the entire male profile in a single direction, and each of them in a reciprocating motion traverses one among the $(n_m+1)$ separate arcs of the female profile, which will be called driving arcs. Furthermore, for only certain relative positions of the male and female organs, there is one additional point of contact between the male profile and the female profile. This point will be called the closure point. On the male profile, this point traverses all the segments such as $R_{max}A$ in a single direction; in the female profile, this point successively and in the same direction describes $(n_m+1)$ other separate arcs. These arcs will be called closure arcs; they join tangentially with driving arcs at $2(n_m+1)$ junction points J.

In the machines that are the subject of the invention, each point such as A belonging to the male profile comes successively into contact with all the junctions points J belonging to the female profile, and only with them, in the relative planetary motion of the male profile with respect to the female profile.

From the properties of the male profile and the relationships between the points A of the male profile and the points J of the female profile, the following properties result for the driving arcs belonging to the female profiles used in the machines according to the invention:

the normal $g_J$ at a point J defining a driving arc is tangent to the circumference $C_{pf}$, centered on $O_f$, of radius $(n+1)E$, at a point $J_1 \equiv J_2$, the normal $g_C$ at any running point C different from J, belonging to the driving arc, intersects the circumference $C_{pf}$ at two real separate points $C_1$ and $C_2$.

Applying the foregoing, there are two ways to define the male profiles of a machine according to the invention: a first way, which constitutes a general method and is indirect, and a second way which is direct but limited.

The general method will be introduced first. According to this method, the procedure is as follows:

A half-driving arc with ends M and J is constructed, such 1) that M is at the distance $R^\circ_m$ from the center $O_f$, the normal $g_M$ to the half-driving arc at M passing through $O_f$ and consequently intersecting the circumference $C_{pf}$ at two diametrically opposed points $M_1$ and $M_2$ [on the condition that $R^\circ_m$ is greater than $(n_m-1)E$, and that the angle $(M\,O_fJ)$ is less than $2\pi/(n_m+1)$], 2) that J is at the distance $R_J$ (greater than $R^\circ_m$) from the center $O_f$ and that the normal $g_J$ to the half-driving arc at J is at a tangent to the circumference $C_{pf}$ at the point $J_1$ coinciding with the point $J_2$, 3) and that for any point C included between M and J, the normal $g_C$ to the half-driving arc intersects the circumference $C_p$ at two points $C_1$ and $C_2$, the point $C_1$ being displaced from $M_1$ to $J_1$ and the point $C_2$ being displaced from $M_2$ to $J_2$ when C traverses the segment MJ. Outside these constraints, the half-driving arc is selected freely.

The half-driving arc is reproduced symmetrically with respect to $g_M$. A complete driving arc is thus defined.

This driving arc is repeated $n_m$ times, by rotation about $O_f$ of the angle $2\pi/(n_m+1)$, in order to adhere to the order of symmetry of the female profile.

By conventional techniques in kinematics, the internal envelope $\Gamma_{im}$ of the set of driving arcs in the planetary motion imposed is determined. This envelope $\Gamma_{im}$ has an order of symmetry $n_m$ with respect to the center $O_m$.

A check is made to verify that this envelope $\Gamma_{im}$ has no double points and that, if it is traversed from the maximum polar radius point to the minimum polar radius point immediately next to it, the polar radius decreases monotonously. If this condition is not met, then the definition of the driving arc must be modified, and the process of constructing the envelope $\Gamma_{im}$ must be started over again. Once that condition is satisfied, the envelope $\Gamma_{im}$ has all the characteristics that are imposed upon the male profiles in the scope of this invention and defines one possible male profile.

Next, the outer envelope $\Gamma_{ef}$ of the male profile in the planetary motion imposed is looked for. This envelope $\Gamma_{ef}$ obviously contains the set of $(n_m+1)$ driving arcs and the $(n_m+1)$ closure arcs. It is accordingly identified with the complete female profile.

It will be observed that the driving arc may in principle have points of abrupt variation in curvature and even angular points insofar as these points meet the symmetry imposed on the driving arc; in particular, the driving arc may be a polygonal line.

The simplest method for constructing a driving arc that is infinitely continuous at all points is as follows:

A first reference segment $\Gamma_{f1}$ is defined, which is identified with a straight segment perpendicular at M to $g_M$; a second reference segment $\Gamma_{f2}$ is defined, which is identified with a circumferential arc centered on $g_M$ at a distance $R_{f2}$ from $O_f$, such that $R_{f2}$ is greater than $R^\circ_m$. The radius of this circumferential arc is equal to $R_{f2}-R^\circ_m$. The polar radii of the curves $\Gamma_{f1}$ and $\Gamma_{f2}$ are linearly composed, at a constant polar angle, with respective weighting coefficients $\mu_1$ and $\mu_2$, such that $\mu_1+\mu_2=1$. The resultant segment is identified with one possible half-driving arc.

Next, the direct way to define machines according to the invention will be introduced. This way of proceeding involves experimentally searching for male profiles that meet the conditions given above. Necessarily, these are curves whose algebraic definition makes it possible to meet these conditions.

Experience leads to choosing the family of hypertrochoids, whose equation in the complex plane $O_mXY$ where $O_mX$ is carried by a half-axis of symmetry of the male profile at which its polar radius is maximal is written as follows:

$$Z_U = X_U + iY_U = R^\circ_m \exp i(\kappa) + E[1 + (\kappa/2)(n_m - 1)]\exp i](1 - n_m)\kappa] - kE[(\tfrac{1}{2})(n_m - 1)]\exp i[(1 + n_m)\kappa] \quad \text{(I)}$$

in which equation expi stands for the imaginary exponential function, in which the angle $\kappa$ is the configuration parameter relative to the running point U, in which $n_m$ is set to be greater than 1, and in which selectively it will be, $k=1$, with $E/R^\circ_m \leqq 1/(n_m^2-1)$, or $k=0$, with $E/R^\circ_m < 1/(n_m-1)$. It will be observed that when $k=0$, the hypertrochoid degenerates into a curtate hypotrochoid, but this degeneration keeps the curve in the set of hypertrochoids that contains the subset of trochoids.

The choice of the relative eccentricity $E/R^\circ_m$ is not completely free; when $k=1$ is chosen, the relative eccentricity is limited by the following condition:

$$E/R^\circ_m \leqq 1/(n_m^2-1)$$

because the male profile becomes looped beyond the limit value, and when $k=0$ is chosen, the relative eccentricity is limited by the following condition:

$$E/R^\circ_m < 1/(n_m-1),$$

which means that the hypotrochoid must be curtate.

In these two profiles, the normal $g_U$ to the running point U passes via the point $U_1$ the affix of which is:

$$Z_{U1} = n_m E \exp i](1 - n_m)\kappa]$$

and this normal intersects the circumference $C_{pm}$ at a second point $U_2$ which is always real and which, when the point U traverses the profile, comes periodically to coincide with the point $U_1$. This point $U_2$ determines an angle $\gamma$ such that:

$$Z_{U2} = n_m E \exp i\gamma.$$

The affix ($Z_C$) of a running point C belonging to a driving arc is written, in the same complex plane as that in which the equation of the male profile is written and in which the center $O_f$ of the female profile occupies the particular position $O^*_f$ defined by its affix $Z_{O^*f} = -E$:

$$Z_C = Z_U \exp i[(-1/n_m + 1)\gamma - E\{1 - \exp i[(n_m/n_m + 1)\gamma\} \quad \text{(II)}$$

and the $n_m$ other driving arcs agreeing in the order of symmetry $(n_m+1)$ about the point $O^*_f$.

The closure arcs of the female profile belong to a hypertrochoid with double points, having the order of symmetry $(n_m+1)$ about $O^*_f$. The affix ($Z_F$) of a running point F belonging to this closure arc is written as follows, in the same complex plane as that in which the equation of the driving arcs is stated:

$$Z_F = Z_U \exp i\{[(n_m - 1)/(n_m + 1)]\kappa\} - E + E \exp i\{[n_m(n_m - 1)/(n + 1)]\kappa\} \quad \text{(III)}$$

When $k=0$ in the equation (I), it is also possible for any curve at the uniform distance D from the male and female profiles defined by the equations above to be adopted as male and female profiles, for given values of $R^\circ_m$ and E. It suffices for these thus-defined profiles to form a fictitious mechanism where the center distance of the axes E is identical to that of the real mechanism, where the ring containing profile has a mean radius equal to $R^\circ_m = D$ and where the ring containing the female profile has a mean radius equal to $R^\circ_m + E - D$, the distance D being counted positively in the centrifugal direction and any curve at a negative distance D from the profiles forming the fictitious mechanism can be retained only if it has no double point whatever.

Extrapolation to the uniformly distant curves does not enlarge the set of possible solutions unless $k=0$, because if $k=1$, the curves at a uniform distance of the male hypertrochoids belonging to the fictitious mechanisms remain hypertrochoids that meet equation (I), which necessarily means the invariance of the female profile as well.

Regardless of how the machines according to the invention are defined, it is the motion of the closure point that, coming successively into contact in a predetermined and immutable order with all the driving points, makes it possible for the section of a work chamber to appear, grow, shrink, then disappear in each cross section of the mechanism. This property makes the association of profiles usable to constitute original helicoidal mechanisms that are distinguished in particular from the known ones in that the chambers close axially in tapered fashion, rather than by the entering into coincidence of two circumferential arcs. This tapered closure is produced at the moment where the joint J of a female profile comes to coincide with the point A of a male profile.

The male and female helicoidal surfaces of machines according to the invention are the only surfaces that have been discovered thus far that can both belong simultaneously to rigid parts. Both of them are machinable. They make it possible moreover to adapt shapes to particular requirements, because of the broadness in the definition of the male and female profiles that they use.

In the machines according to the invention, the helicoidal surfaces can degenerate into cylindrical surfaces, when the inverses of the male pitch ($1/P_m$) and female pitch ($1/P_f$) tend to zero. These surfaces are then entirely defined by their cross section. The work chambers are axially closed by end plates, and the fluid can be admitted radially into the mechanism and escape from it in the same way.

In the case of degeneration, those machines whose male profile is a hypertrochoid are excluded from the machines according to the invention.

In the cylindrical mechanisms of the machines according to the invention, the closure arcs are no longer indispensable for the closure of the chambers. They can be replaced with arcs which are outside them, and with which the male profile no longer comes into contact.

Either if they include a helicoidal or a cylindrical mechanism, the machines according to the invention may involve any combination of absolute motions making it possible to realize the relative planetary motion of the male organ with respect to the female organ. In fact, two possibilities have obvious practical importance.

In a first possibility, which is the one generally used to make downhole motors intended for petroleum, gas or geothermal drilling, the female organ belongs to the stator, and so the female surface and profile can then be categorized as statoric. The relative planetary motion of the male organ becomes absolute, and the male organ constitutes the rotor of the machine.

If, for tribological reasons in particular, the portion of the stator limited by the statoric surface must be constituted by a layer of elastomer, and the thickness of this layer may be limited to a minimum, since because the statoric and rotoric surfaces are rigorously conjugated by sliding, no local deformation need to be provided to overcome any gearing defect. The result in particular is a reduction and regularizing of parasitic resistances to the motion.

When the motion of the male organ is an absolute planetary motion, this motion can result in the only contacts between the male organ and the portions of the female surface whose directrix is the driving arcs. In that case, the male organ can be linked to a primary shaft coaxial with the female surface by an open kinematic chain constituted successively by a toric connection, an intermediate shaft, and a second toric connection, a thrust bearing being disposed between the primary shaft and the stator to prevent any translation of the male organ along its axis. It should also be noted that one does not depart from the scope of the invention if the open kinematic chain that has just been described is replaced with any mechanical system that gives the male organ and the primary shaft the same relative freedom as that of this kinematic chain.

In the same case where the motion of the male organ is an absolute planetary motion, this motion may result in the articulation of the male organ on a crankshaft rotoidally connected to the stator, about the axis of the female surface, and in the existence of a transmission having the ratio $n_m/n_m+1$ joining the male and female organs.

In a second possibility for creating the relative planetary motion, which in particular can be exploited to make screw-type compressors, the male organ is rotoidally connected with a stator about the axis of the male surface, and the female organ is rotoidally connected with the stator about the axis of its inner surface imposed by a transmission having the ratio $n_m/n_m+1$ (female surface), the relative planetary motion being joining the male and female organs.

In any machine according to the invention which includes a crankshaft, and in machines where the male and female organs are rotoidally connected to the stator, the transmission of the ratio $n_m/n_m+1$ joining the male and female organs can result from direct contacts between the male surface and the portions of the female surface whose directrix is the driving arcs, if the fluid with which the machine exchanges energy is a liquid having a lubricating action on the surfaces contacting one another, or a gas containing such a liquid. Otherwise, the tolerances on the male and female surfaces must allow slight clearance in their gearing, and the relative planetary motion must be imposed by a transmission outside the mechanism.

Regardless of the absolute motions driving the male and female organs, the female organ (tubular body) may be made up of a plurality of identical pieces, which are not very slender, defined by planes perpendicular to the axis, aligned and assembled to constitute a single device.

BRIEF DESCRIPTION OF THE DRAWINGS

FIG. 1 relates to the prior art.

FIGS. 2–6 illustrate the general method of defining male and female profiles for machines according to the invention.

FIGS. 7 and 8 relate to the direct definition of male profiles for machines according to the invention.

FIGS. 9 and 10 relate to the construction of female profiles conjugated with the male profiles of FIGS. 7 and 8, respectively.

FIGS. 11–19, on a smaller scale, show the evolution of the cross section of a chamber defined by the profiles constructed with FIGS. 7 and 9, respectively, this evolution being an essential characteristic of any machine according to the invention, which identifies it unambiguously with respect to any known machine.

FIGS. 20 and 21, respectively, show a machine according to the invention in which the tubular body (female organ) is fixed in the stator, and on a larger scale, the corresponding helicoidal mechanism.

FIG. 22 is a detail of FIG. 21 and, on a still larger scale and with the stator removed, shows the lines of contact of the male surface with the female surface and the way in which these lines define the chambers of the mechanism.

FIGS. 23 and 24 show the essentials of a machine according to the invention, including a helicoidal mechanism in which the male organ and the female organ are each in rotoidal connection with the stator.

FIGS. 25 and 26 are two sectional views in a machine according to the invention, in which the tubular body (female organ) is fixed in the stator, which includes a crankshaft and whose mechanism is cylindrical.

FIG. 27 is a fragmentary section in a machine which differs from that shown in FIG. 25 and 26 by the lack of physical embodiment of the closure arcs.

FIG. 28 shows a machine according to the invention including a helicoidal mechanism whose tubular body is made of a plurality of identical pieces.

DETAILED DESCRIPTION OF PREFERRED EMBODIMENTS

Figure 1:
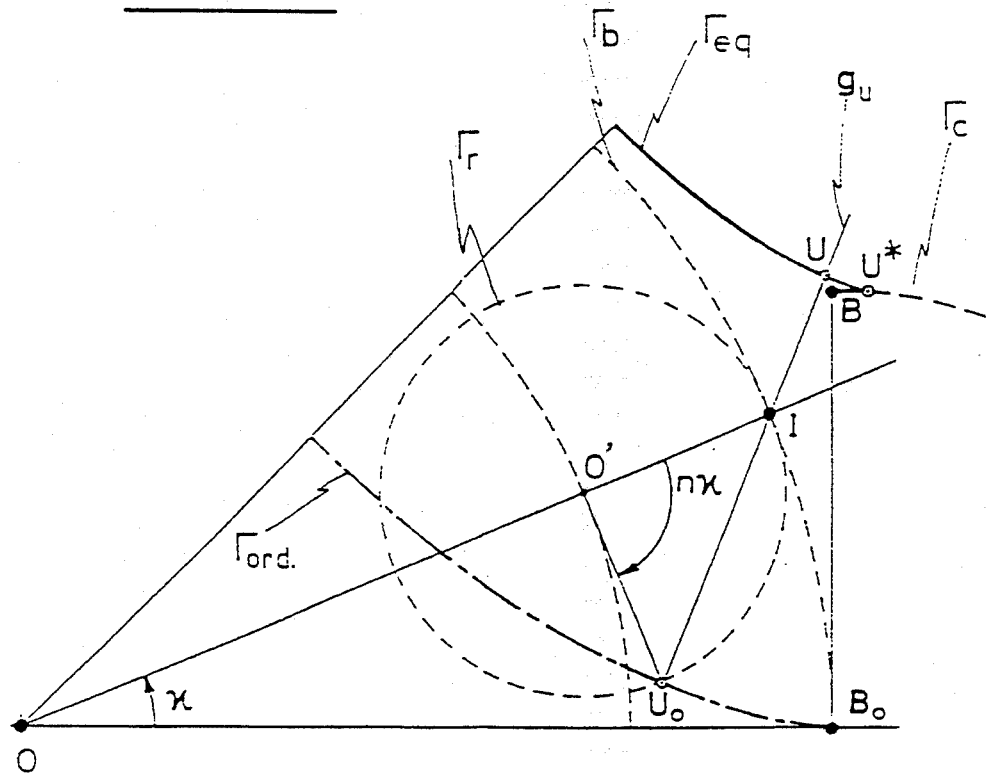
FIGS. 1–28 illustrate the particular features and applications of the above.

FIG. 1 recalls the construction of the running point $U_0$ of an ordinary trochoid $\Gamma_{ord}$ with the center O and having the order of symmetry n, for a configuration parameter value that locates the point $U_0$ in the vicinity of a retrogressive point $B_0$. This drawing also shows the construction of the point U of the curve $\Gamma_{eq}$ at a uniform distance D from this trochoid $\Gamma_{ord}$, for the same value of the configuration parameter kappa.

The base circumference $\Gamma_b$ with the center O and the rolling circumference $\Gamma_r$ of center O' can be seen, these two circumferences being tangent at I.

At the point $U_0$, the normal $g_U$ to the ordinary trochoid passes through the point I, and the point U of the curve $\Gamma_{eq}$ is obtained by marking off the distance $D=U_0U$ on this normal.

A cusp B of $\Gamma_{eq}$ corresponds to the cusp $B_o$ of $\Gamma_{ord}$; however, between U and B the swing of the normal $g_U$ makes the existence of another cusp U* in $\Gamma_{eq}$ inevitable; the curve $\Gamma_{eq}$ accordingly has a reentrant arc U*B, and the profile containing $\Gamma_{eq}$ that extends it beyond B by a circumference $\Gamma_c$ having the center $B_0$ cannot be physically embodied in the strict sense.

Figure 2:
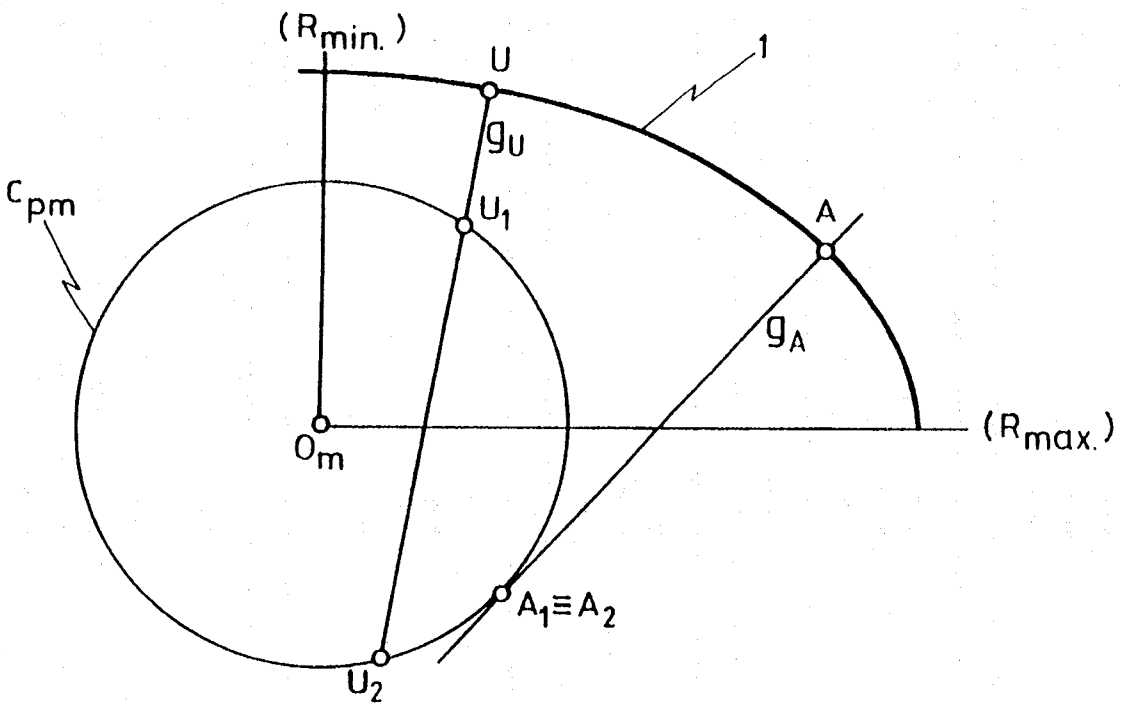

FIG. 2 illustrates the properties imposed on the male profile 1. One can see the circumference $C_{pm}$ having the center $O_m$ and the radius $n_mE$, the points U and A belonging to an arc of the male profile defined by two points of successive extreme polar radius, the normals $g_U$ and $g_A$ as well as the intersections of these normals with the circumference $C_{pm}$ at the respective points $U_1$ and $U_2$, $A_1 \equiv A_2$.

Figure 3:
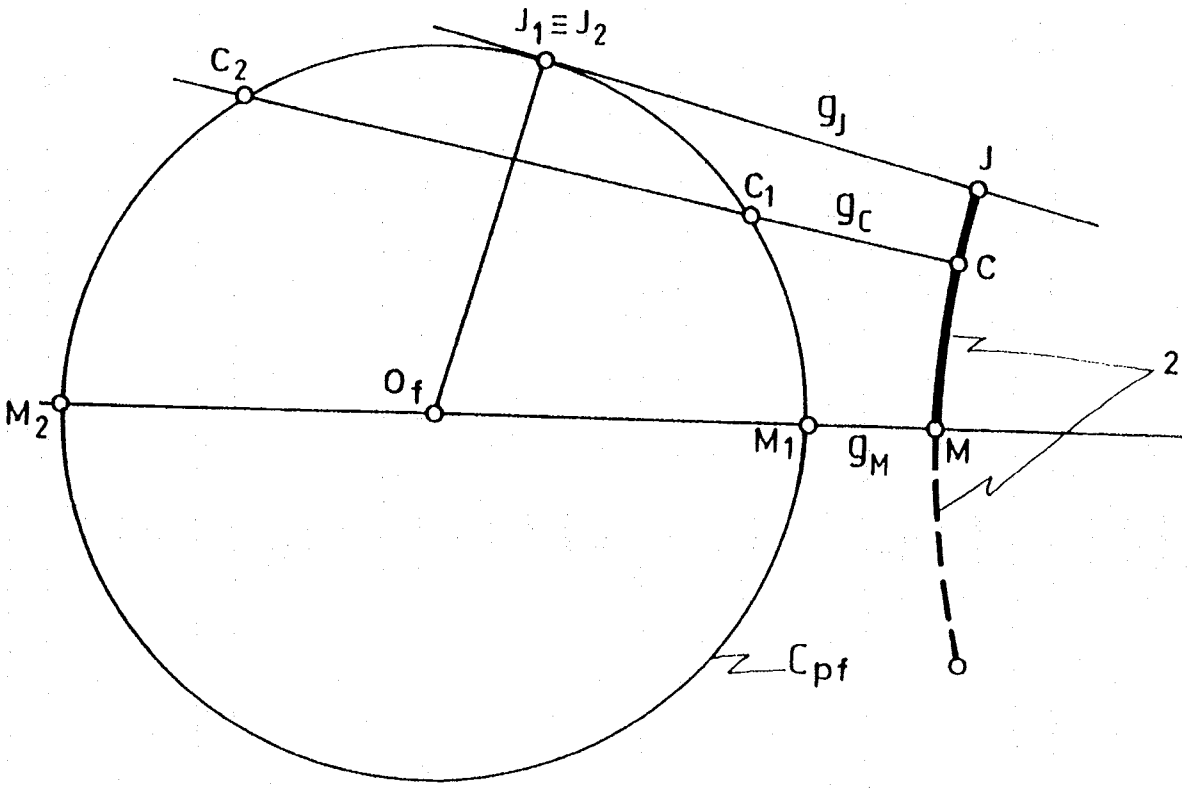
Figure 4:
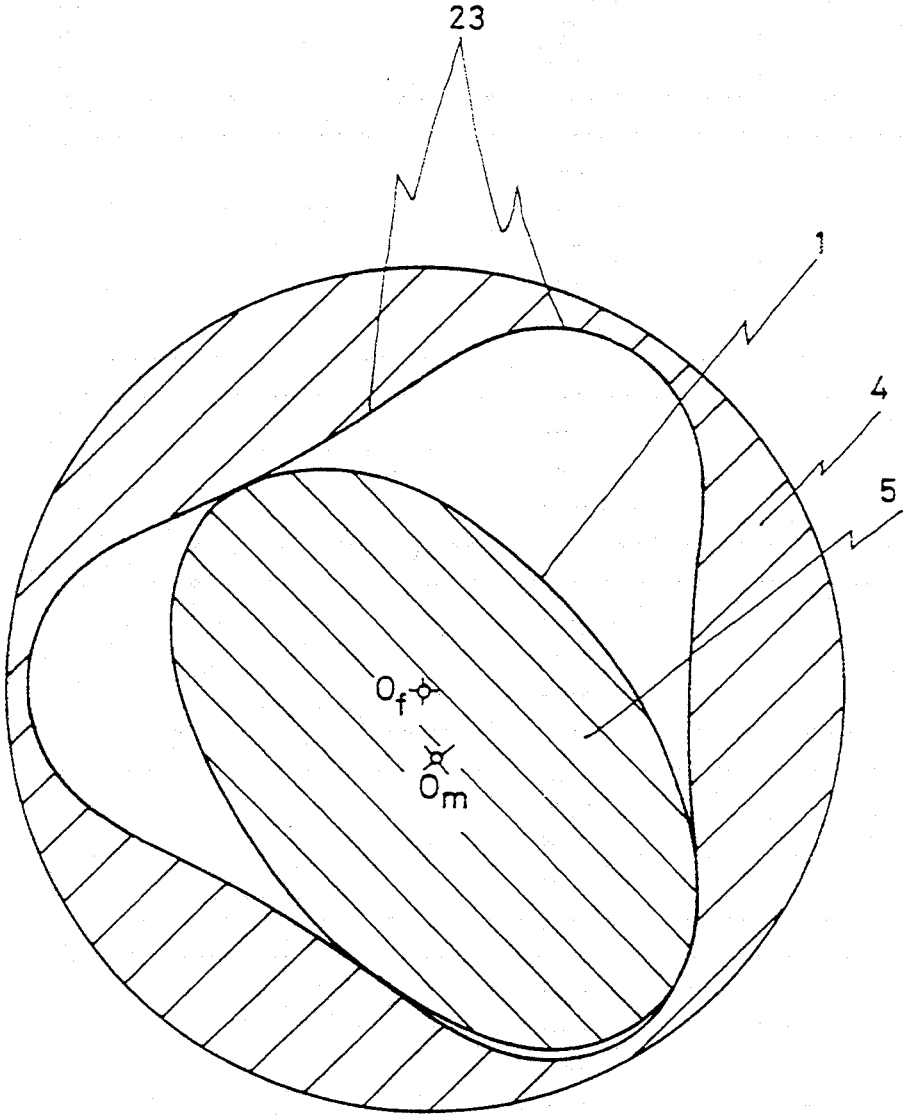

FIG. 3 illustrates the properties of the driving arc 2 belonging to the female profile of the machine schematically shown in FIG. 4. Here the circumference $C_{pf}$ having the center $O_{ff}$ and the radius $(n_m+1)E$, the points M, J and C belonging to a half-driving arc, the normals $g_M$, $g_J$ and $g_C$, and the intersections of these normals with the circumference $C_{pf}$ at the respective points $M_1$ and $M_2$, $J_1 \equiv J_2$, $C_1$ and $C_2$ can all be distinguished in this figure.

FIG. 4 shows a computer model of male and female profiles in a machine according to the invention, where the half-driving arc is characterized by the following parameters defined according to the indirect method:

$R^\circ_m = 40$ mm
$E = 10$ mm
$R_{f2} = 100$ mm
$\mu_2 = 0.8$
$n_m = 2$

The center $O_m$ of the male profile, the cross section 5 of the male organ, and the cross section 4 of the female organ appear in this figure.

Figure 5:
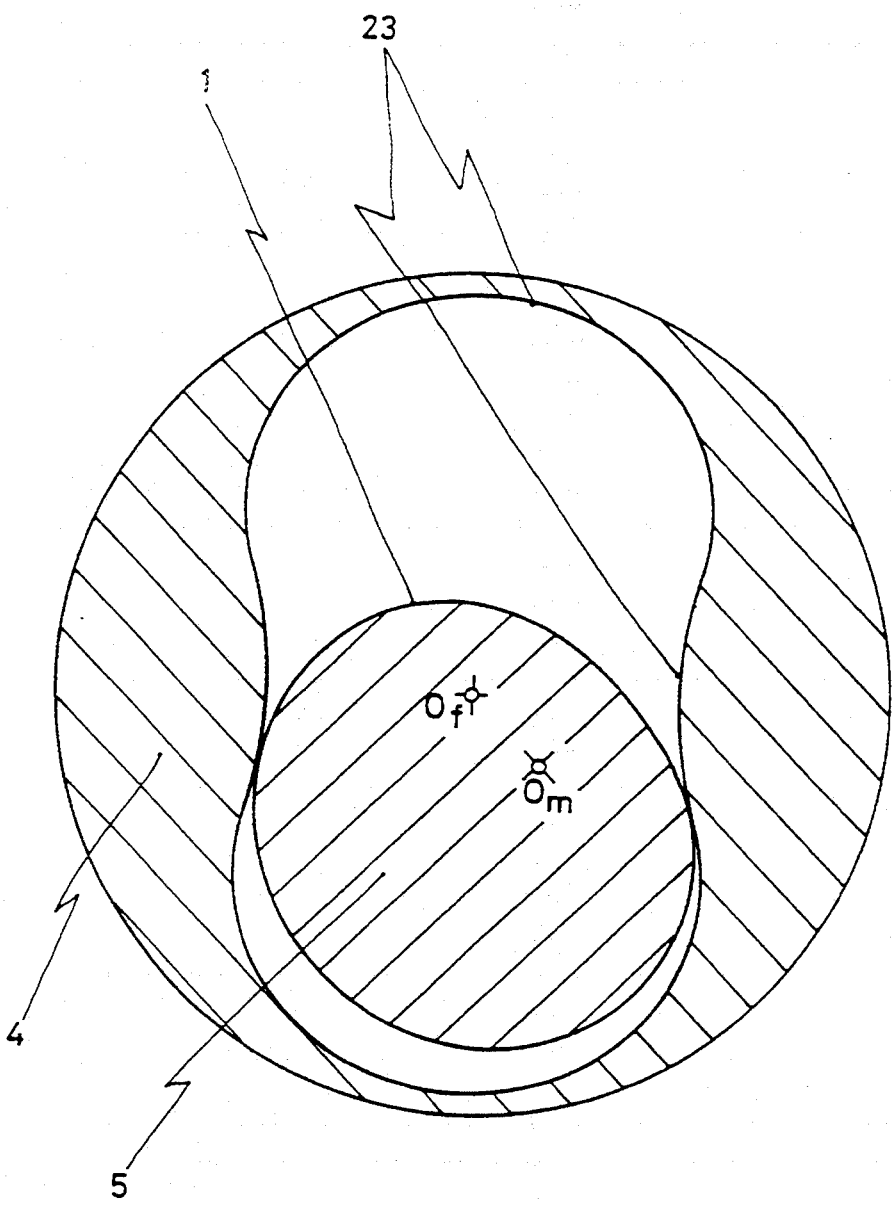
Figure 6:
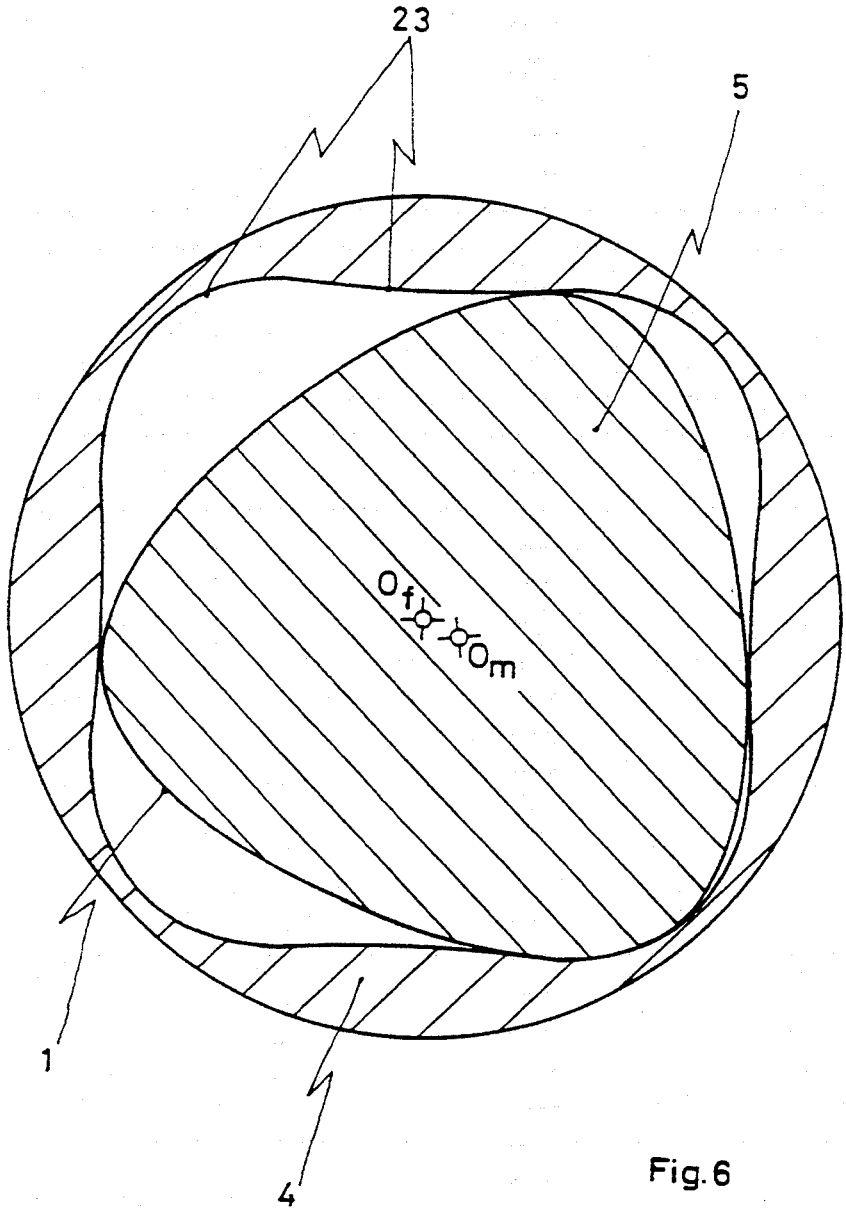

FIGS. 5 and 6, with the same notations as FIG. 4, show two other models of machines according to the invention, characterized respectively by the following parameters defined according to the indirect method:

$R^\circ_m = 52$ mm
$E = 24$ mm
$R_{f2} = 200$ mm
$\mu_2 = -0.5$
$n_m = 1$ and $R^\circ_m = 40$ mm
$E = 4.5$ mm
$R_{f2} = 100$ mm
$\mu_2 = 2$
$n_m = 3$.

Figure 7:
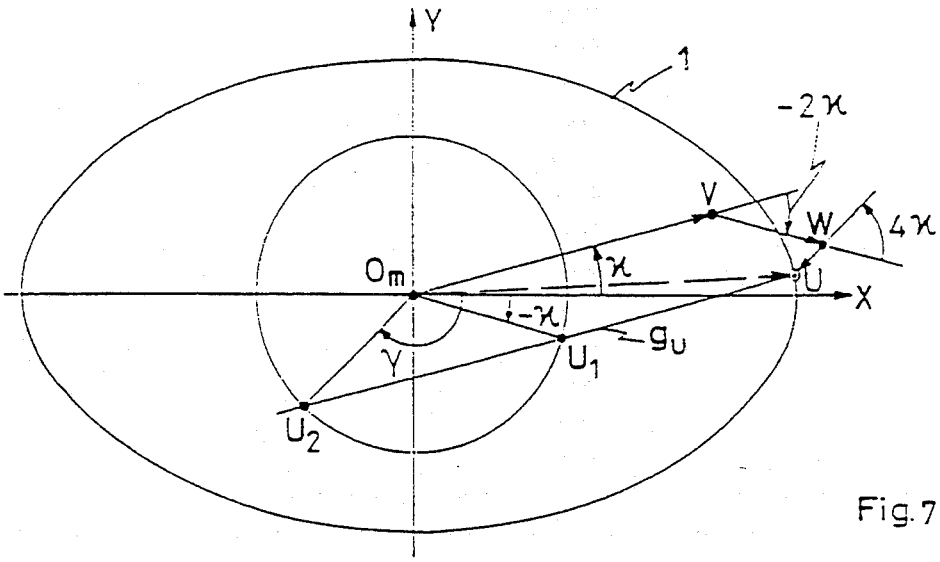

FIG. 7 shows the geometric construction of the running point U of a male profile 1 belonging to a machine according to the invention, in the particular case where the male profile is identified with a hypertrochoid satisfying equation (I), where $n_m = 2$, $k = 1$, and $E/R^\circ_m = \frac{1}{4}$ (first example of the direct way of defining a male profile).

The profile is constructed within the system of axes $O_mXY$, and the point U corresponds to a running value kappa of the configuration parameter. The vector $O_mU$ results from the composition in accordance with equation (I) of a first vector $O_mV$ of modulus $R^\circ_m$ inclined by the angle kappa with respect to the axis $O_mX$, a second vector VW of modulus 3E/2 inclined by the angle $(-2\kappa)$ to the first, and a third vector WU of modulus E/2 inclined by the angle $(4\kappa+\pi)$ to the second one. The normal $g_U$ at U passes through the point $U_1$ of the circumference $C_{pm}$ having the center $O_m$ and the radius $n_mE = 2E$, such that $O_mU_1$ is inclined by the angle $(-\kappa)$ to the axis $O_mX$, and it intersects the circumference $C_{pm}$ a second time at the point U2 that determines the angle $\gamma$ equals $(O_mX, O_mU_2)$.

Figure 8:
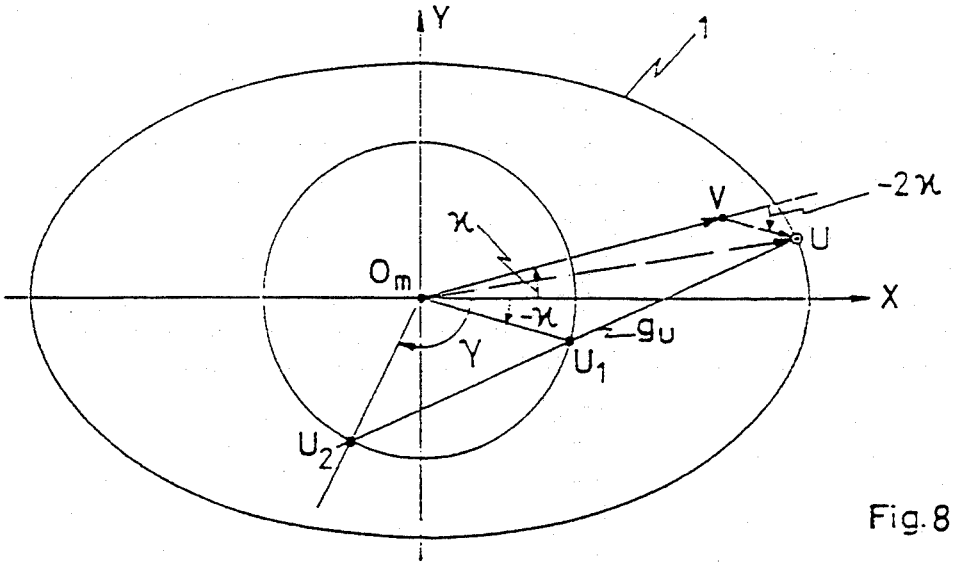

FIG. 8 shows the geometric construction of the running point U of a male profile 1 belonging to a machine according to the invention, in the particular case where the male profile is identified with a hypertrochoid satisfying equation (I), where $n_m = 2$, $k = 0$, and $E/R^\circ_m = \frac{1}{4}$ (second example of the direct way of defining a male profile).

The profile is constructed within the system of axes $O_mXY$, and the point U corresponds to a running value kappa of the configuration parameter. The vector $O_mU$ results from the composition in accordance with equation (I) of a first vector $O_mV$ of modulus $R^\circ_m$ inclined by the angle $\kappa$ with respect to the axis $O_mX$, a second vector VU of modulus E inclined by the angle $(-2\kappa)$ to the first. The normal $g_U$ at U passes through the point $U_1$ of the circumference $C_{pm}$, and intersects the circumference $C_{pm}$ a second time at the point U2 that determines the angle $\gamma$ as above.

Figure 9:
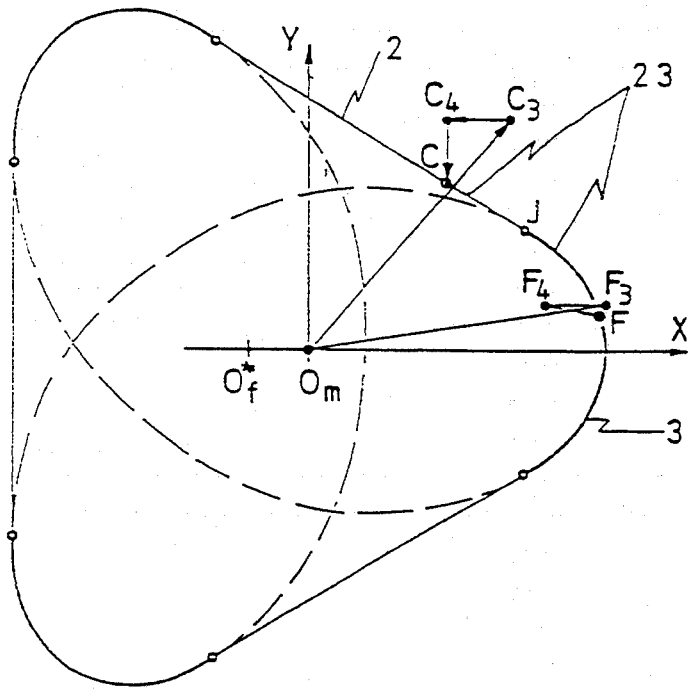

FIG. 9 shows the construction of a running point C belonging to the driving arc 2 and of a running point F belonging to the closure arc 3 of the female profile 23, which come into contact at different times with the same point U of the male profile shown in FIG. 7. The female profile to which the points F and C belong is drawn in the same system of axes $O_mXY$ as the male profile. The vector $O_mC$ (not drawn) results from the composition, according to equation (II), of a first vector $O_mC_3$, which is the vector $O_mU$ of FIG. 7, rotated by the angle $(-\gamma/3)$ a second vector $C_3C_4$ of modulus E inclined by the angle $\pi$ to $O_mX$, and a third vector $C_4C$ of modulus E, inclined by the angle $(2\gamma/3)$ to $O_mX$.

The vector $O_mF$ (not drawn) results from the composition, according to equation (III), of a first vector $O_mF_3$, which is the vector $O_mU$ of FIG. 7, rotated by the angle $(\kappa/3)$, a second vector $F_3F_4$ of modulus E inclined by the angle $\pi$ to $O_mX$, and a third vector $F_4F$ of modulus E, inclined by the angle $(-2\kappa/3)$ to $O_mX$.

Figure 10:
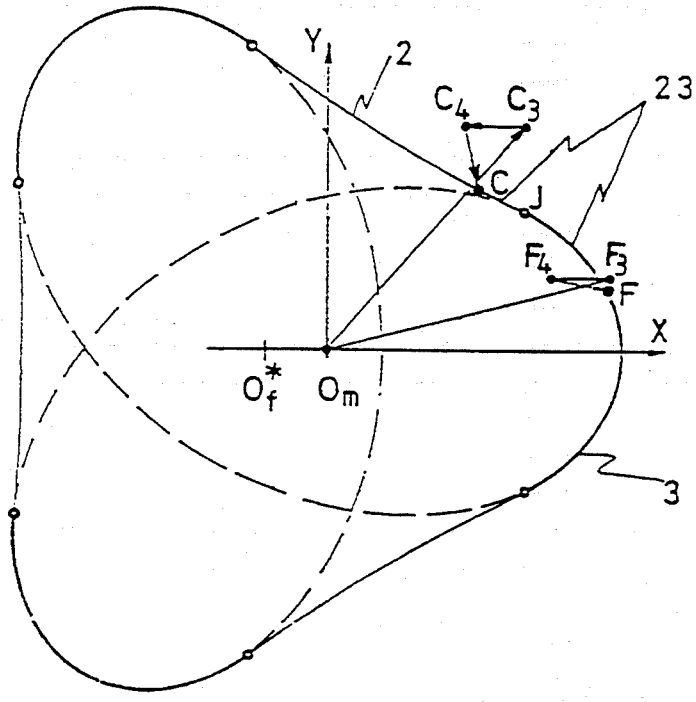

FIG. 10, in the same manner as FIG. 9, shows the construction of a running point C belonging to the driving arc 2 and of a running point F belonging to the closure arc 3 of the female profile 23, which come into contact at different times with the same point U of the male profile shown in FIG. 8.

In these two FIGS. 9 and 10, one has drawn entirely the hypertrochoid with double points to which the closure arcs belong, whose physical portion is limited to the points such as J where they are joined to the driving arcs. The portions not physically embodied of the hypertrochoid appear in dashed lines in these drawings.

FIGS. 11–19 describe the very characteristic evolution of the cross section of a chamber defined by the male and female profiles of FIGS. 7 and 9, in the planetary motion of the male profile relative to the female profile.

The cross section of the chamber which is considered is shaded in all the figures where this section has a sufficient area for this to be possible. In each figure, the direction of the two rotations that compose the relative planetary motion have been indicated. The arrow in solid lines symbolizes the rotation of the male profile (i.e., the second rotation) about the center $O_m$, which is never so indicated but rather is identified by a small blackened circle. The arrow in dashed lines symbolizes the rotation of the center $O_m$ of the male profile (i.e., the first rotation) about the center $O_f$ of the female profile.

At each stage in the evolution of the section of the chamber in question, the shape of this section is that of a crescent, and the ends of the crescent are understood to be the points of contact of the two profiles, male and female.

A point of contact is designated by the symbol $C^i$ when it belongs to a driving arc (i=1, 2 or 3), and it is designated by the symbol F when it belongs to a closure arc.

During the relative motion of the two profiles, a point such as $C^i$ indefinitely describes the driving arc i, first in one direction and then in the other, while F traverses the hypertrochoid with double points, always in the same direction, but it is not material and hence useful to the closure of a chamber except during the period of time when it traverses the closure arcs, and it is not shown in FIGS. 11–19 except during its presence on a single closure arc, where it is useful to the reasoning.

Figure 11:
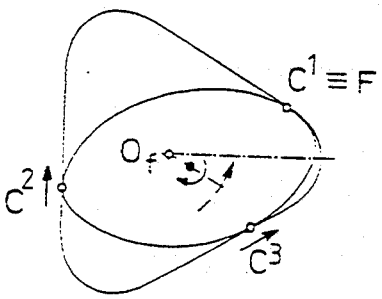

In FIG. 11, the point $C^1$ arrives at the end of the driving arc that it describes at the moment when the point F enters the closure arc joined to it here. The two points $C^1$ and F coincide, and their separation will engender the chamber whose evolution is to be followed.

Figure 12:
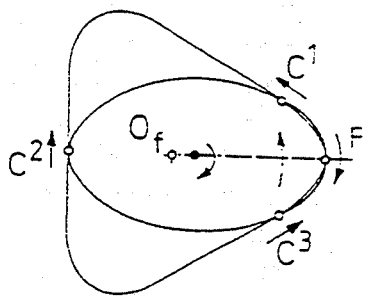

In FIG. 12, the points $C^1$ and F are separated, and F has reached an apex of the female profile. The section of the chamber in question has begun to grow.

Figure 13:
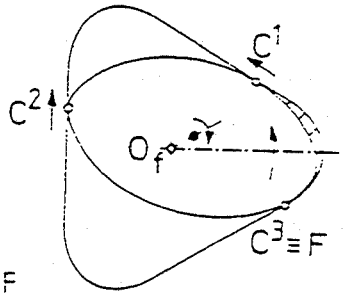

In FIG. 13, the point F has reached the end of the closure arc at the moment when this same point, on the driving arc to which it also belongs, is reached by the point $C^3$. The point F will disappear, and the point $C^3$ will replace it to close the section of the chamber in question, whose growth it promotes by retracing its path along its driving arc.

Figure 14:
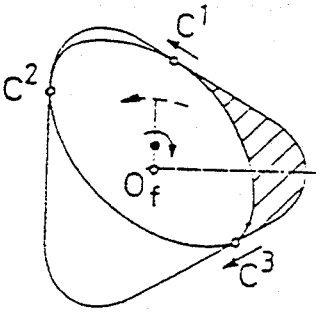

In FIG. 14, the section of the chamber in question is limited by the points $C^1$ and $C^3$, which continue to move apart from one another along the female profile.

Figure 15:
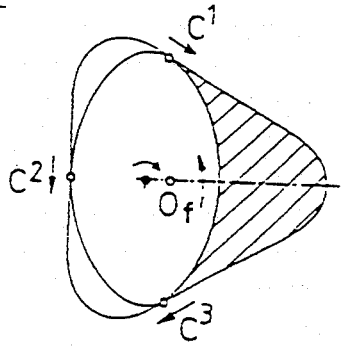

In FIG. 15, the section of the chamber in question has reached its maximum. It is still limited by the points $C^1$ and $C^3$, but compared with the motion that drive it in FIG. 13, $C^1$ has retraced its path, while $C^3$ is still progressing in the same direction.

Figure 16:
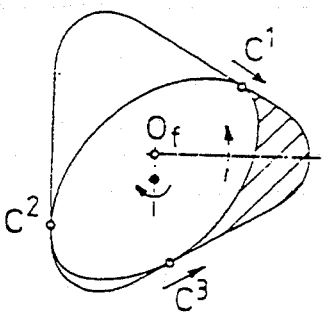

In FIG. 16, the points $C^1$ and $C^3$ still limit the section of the shaded chamber, but $C^1$ and $C^3$ approach one another along the female profile. The section of the chamber is decreasing in size.

Figure 17:
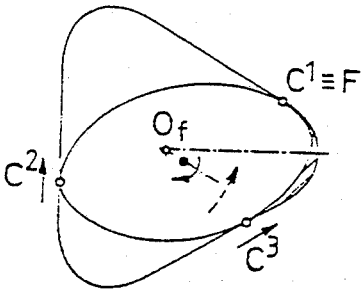

In FIG. 17, the point F reappears at the end of the closure arc at the same moment when the point $C^1$ arrives at this end and stops there. The section of the chamber continues to shrink.

Figure 18:
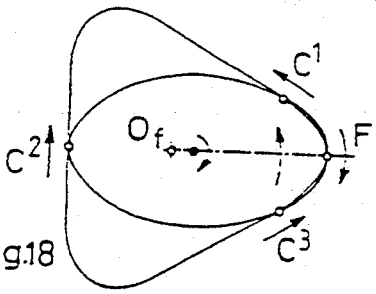

In FIG. 18, the point F has replaced the point $C^1$ as the end of the section of the chamber. F has reached the apex of the closure arc, and the points $C^3$ and F are progressing toward one another. The section of the chamber is about to disappear.

Figure 19:
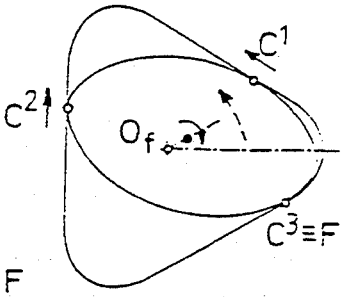

In FIG. 19, finally, points F and $C^3$ have rejoined one another, and the section of the chamber has vanished.

Figure 20:
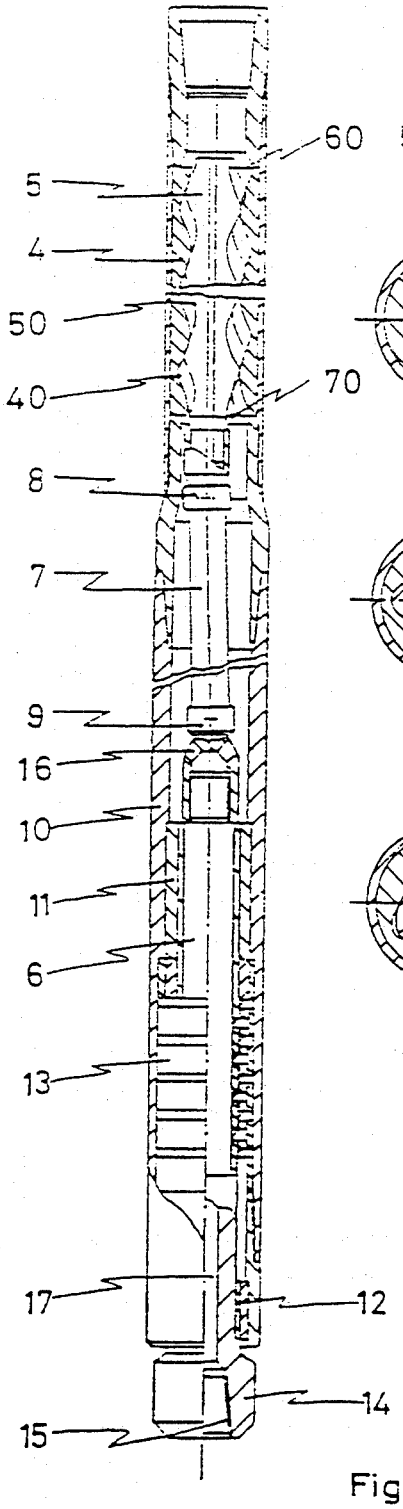

FIG. 20 shows an axial section in a machine according to the invention, including a helicoidal mechanism, where the female organ belongs to the stator—the female surface is identified with the statoric surface—and where the planetary motion of the male organ is accordingly absolute.

This involves a downhole motor used in deep drilling and driven by the pressurized drilling mud, in which the male profile corresponds to a hypertrochoid meeting equation (I), where $k=1$ and $n_m=2$ (first example of the direct way of defining a male profile).

One can see, the rotor 5 limited on the outside by the rotoric surface 50 and the tubular statoric body 4 limited on the inside by the statoric surface 40 are seen. The rotor 5 is guided in its planetary motion by the linear contacts between statoric and rotoric surfaces, and it is linked with the primary shaft 6 by the intermediate shaft 7, which by way of toric connections physically embodied by Cardan joints 8 and 9, is linked respectively with the rotor 5 and the primary shaft 6. This primary shaft 6 prevents any axial translational motion of the rotor 5, via its rotoidal connection with the element 10 of the stator, a connection made by the plain radial bearings 11 and 12 and the thrust bearing 13 with multiple rows of rolling elements.

The drilling mud that enters the mechanism by its end open section 60, exhausts by its open end 70 and is then carried to the drilling tool fastened to the end collar 14 by the threaded assembly 15, passing through the orifices 16 and the bore 17 of the primary shaft.

Figure 21:
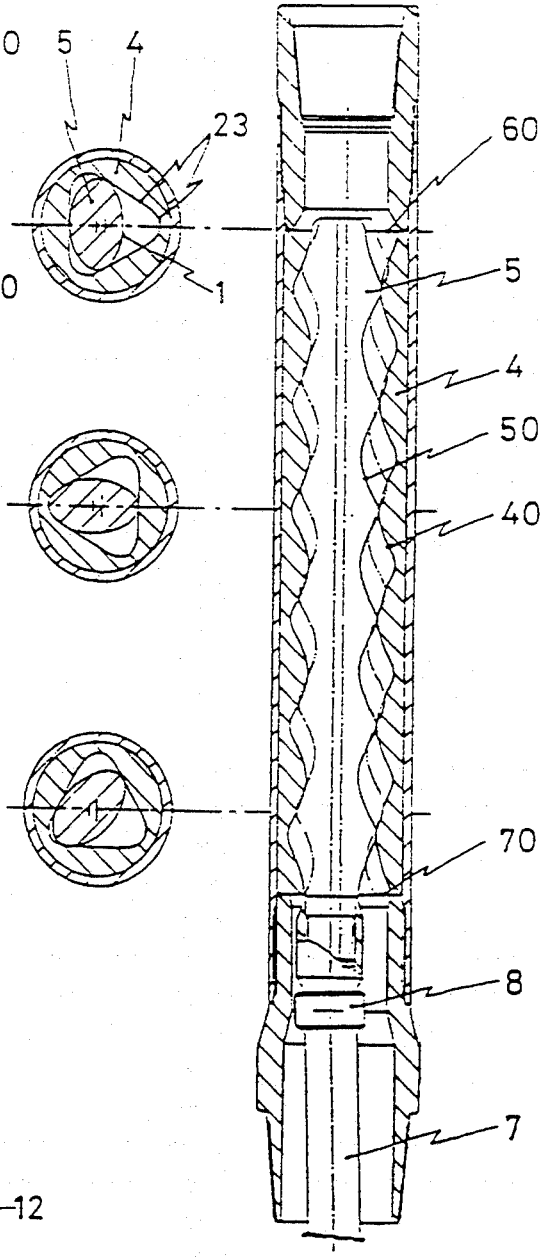

FIG. 21 is a complete axial section on a larger scale of the mechanism of the motor of FIG. 20, supplemented with three cross sections in this mechanism.

The statoric tubular body 4 and the rotor 5 are seen here, whose respective profiles 23 and 1 appear in the cross sections, along with part of the intermediate shaft 7 and its toric connection 8 with the rotor.

Figure 22:
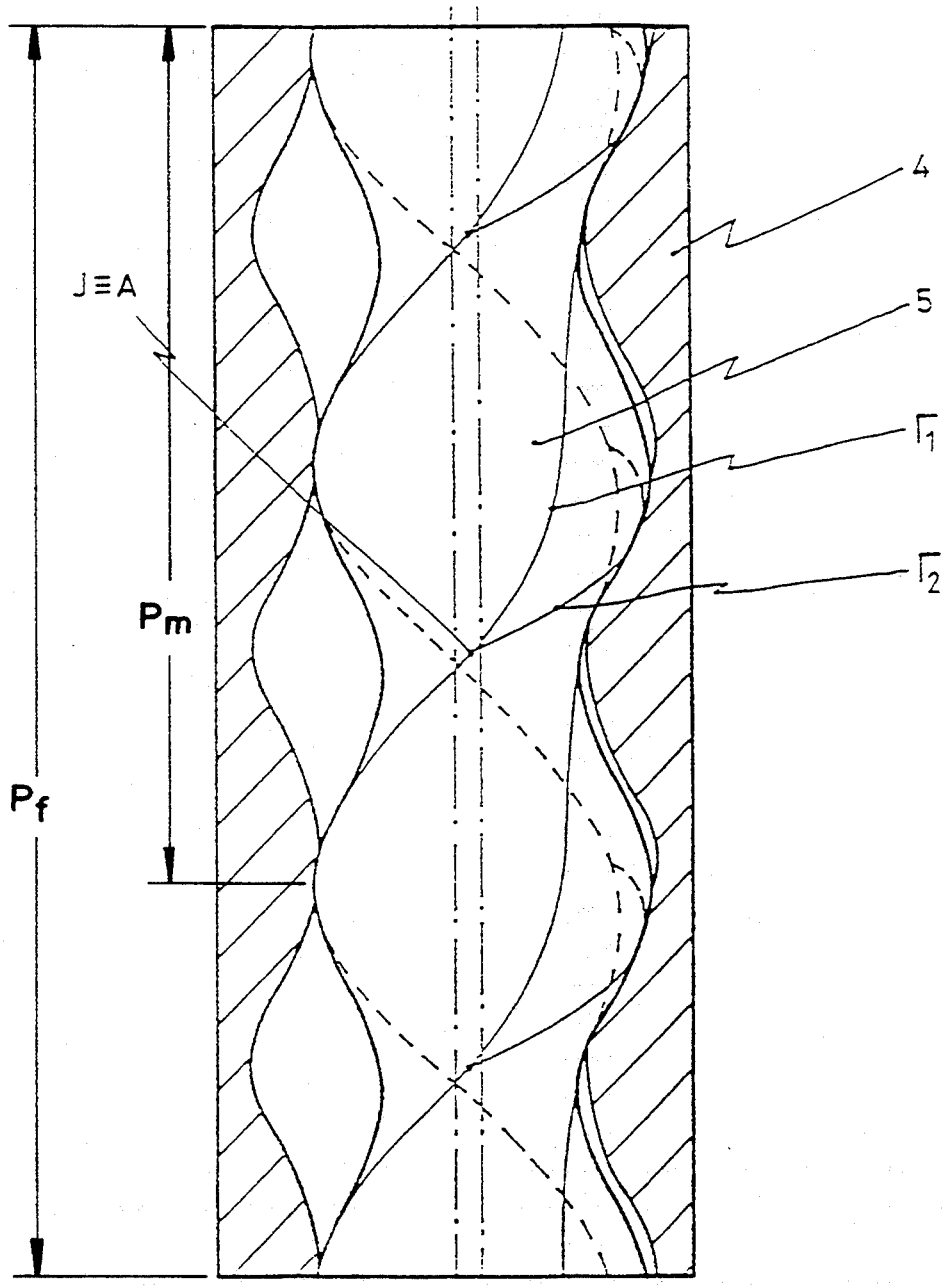

FIG. 22, in axial section, shows part of the mechanism shown in FIG. 21, on a still larger scale to enable visualization of the lines of contact such as $\Gamma_1$ and $\Gamma_2$, which intersect at a point $J \equiv A$. It appears that the lines of contact close axially in a tapered fashion the chambers that they define, which is the case for all the helicoidal machines that are the subject of the invention, but is not so for any other known machine of the same type where the order of symmetry of the female profile exceeds that of the male profile by one unit.

Figure 23:
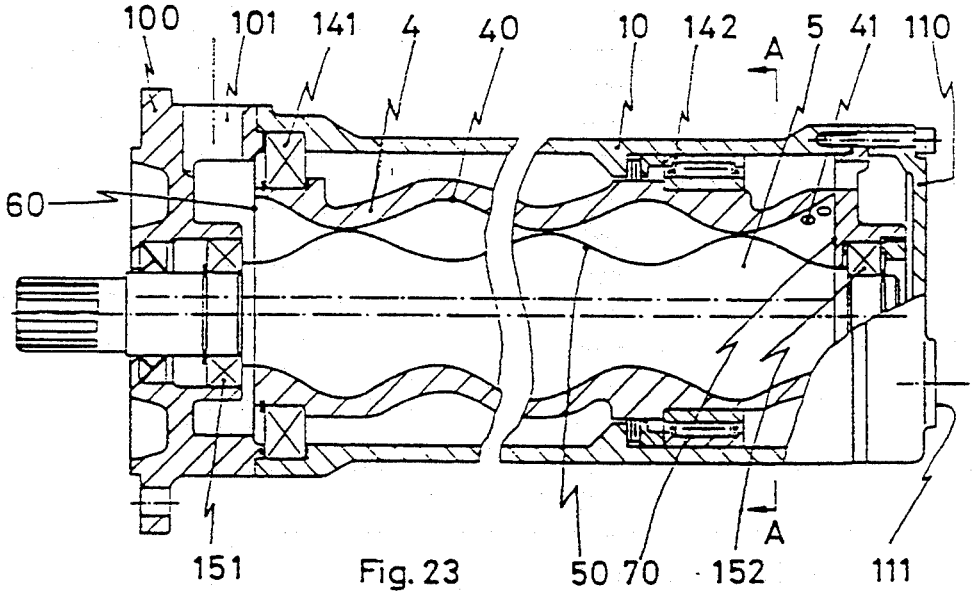

FIG. 23 is an axial section in a machine according to the invention, including a helicoidal mechanism, where the male and female organs of the mechanism are both in rotoidal connection with the stator.

Figure 24:
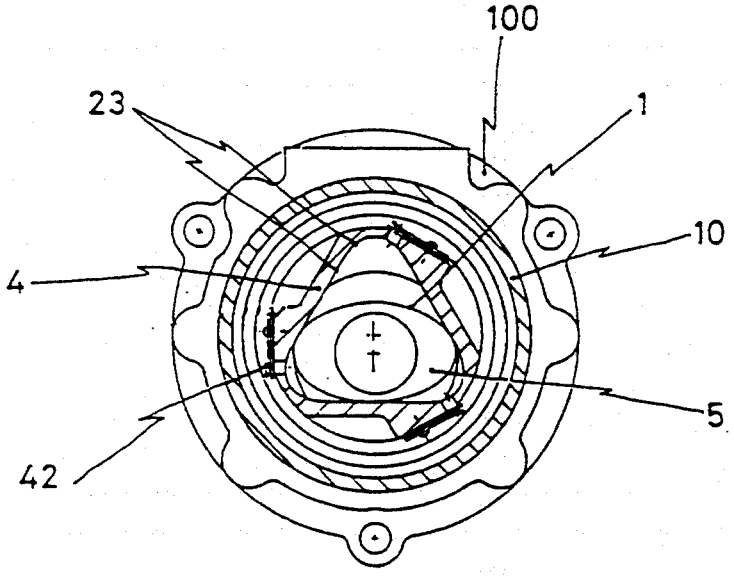

FIG. 24 is a cross section along the line AA of the machine shown in FIG. 23. This machine is a screw-type compressor for gas containing a lubricant, such that the male organ 5 defined on the outside by the male surface 50 to which the male profile 1 belongs can directly drive the tubular body 4 defined on the inside by the female surface 40 to which the female profile 23 belongs, without intervention from any gearing external to the mechanism.

Furthermore, in these last two figures can be seen, the stator including a tubular portion 10, a flange 100, through the port 101 of which the fluid is admitted into the machine, and a flange 110 by which, at 111, the compressed fluid escapes towards the outside of the machine. The flange 110 is of course apparent in FIG. 23 only. In this same drawing, in the respective flanges 100 and 110, the rolling bearings 151 and 152 are also seen, which physically embody the rotoidal connection of the male organ 1 with the stator, and the rolling bearings 141 and 142 which physically embody the rotoidal connection between the tubular body 4 and the tubular body 10 of the stator.

The admission of the fluid into the mechanism from the flange 100 is done via the open end section 60 of the mechanism, and the exhaust of the compressed fluid via the flange 110 is done via openings such as 41, which are open in the female surface and are controlled by valves such as 42 (FIG. 24). The flange 110 completely plugs the terminal section 70 of the mechanism.

Figure 25:
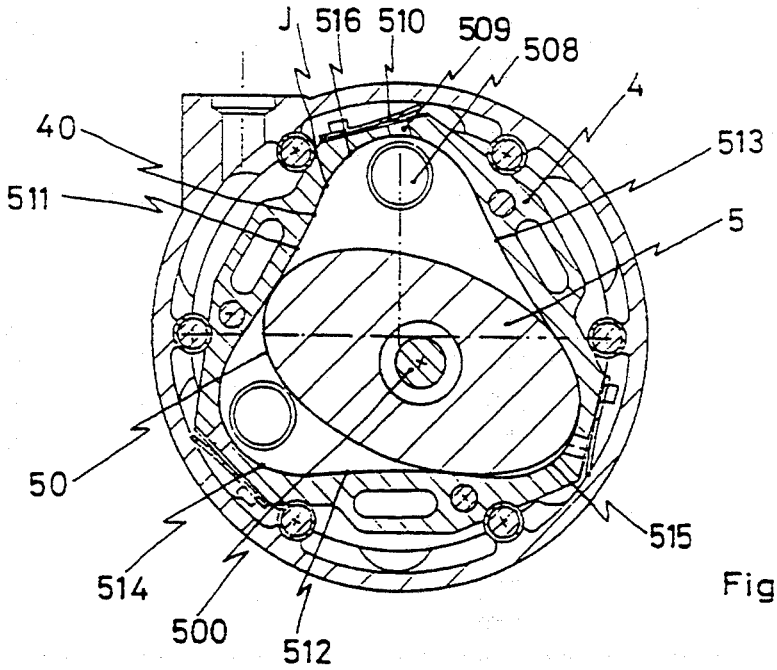

FIG. 25 is a cross section perpendicular to the axes of male and female surfaces 50 and 40, respectively, in a compressor according to the invention where the mechanism is cylindrical (in the case of degeneration).

Figure 26:
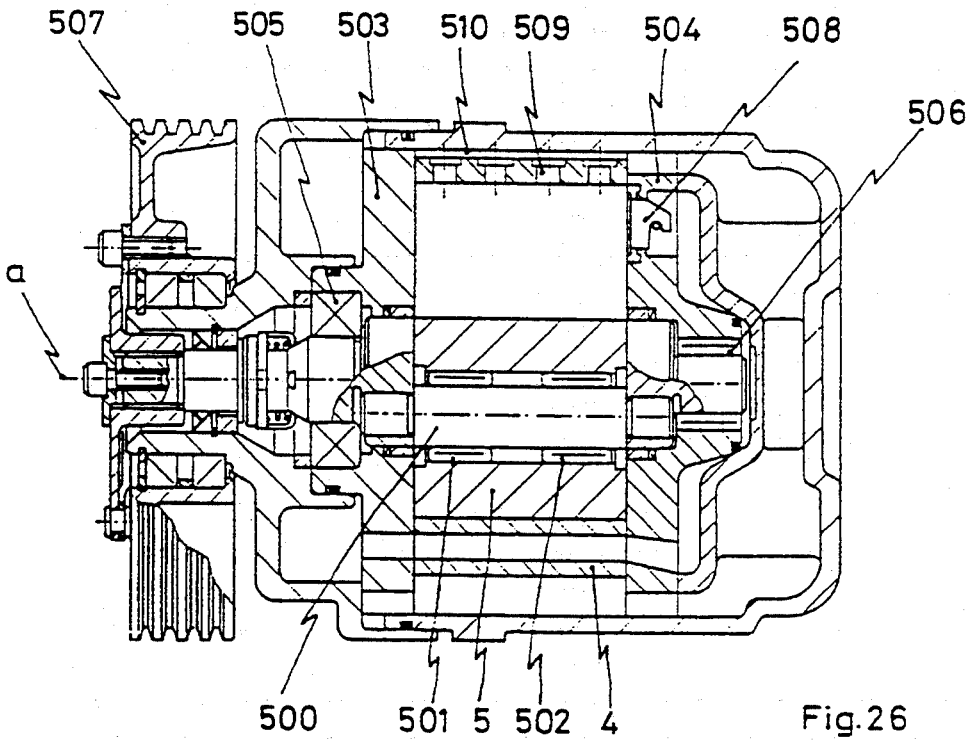

FIG. 26 is a section via a plane containing the axis of the female surface 40 in the same compressor.

In the compressor shown in FIGS. 25 and 26, the female organ 4 (tubular body) can be seen, closed by flanges 503 and 504, as can the male organ 5, connected to a crankshaft 500 in rotoidal connection with the flanges 503 and 504 belonging to the stator. The needle roller bearings 501 and 502 physically embody the rotoidal connection of the male organ 5 to the crankshaft 500, and the roller bearings 505 and 506 physically embody the rotoidal connection between the crankshaft 500 and the flanges 503 and 504 belonging to the stator;

the pulley 507 is connected with the crankshaft 500. The gas containing lubricant, compressed in this machine, is aspirated through valves such as 508, accommodated in the flange 504, and it is expelled through orifices such as 509, which are provided with valves such as 510.

In FIG. 25, among other features, the driving arcs 511, 512 and 513, the closure arcs 514, 515 and 516, and the junction points such as J at which the arcs are joined two by two can be distinguished. The set of these six arcs is identified with the female profile drawn on a different scale in FIG. 4.

Figure 27:
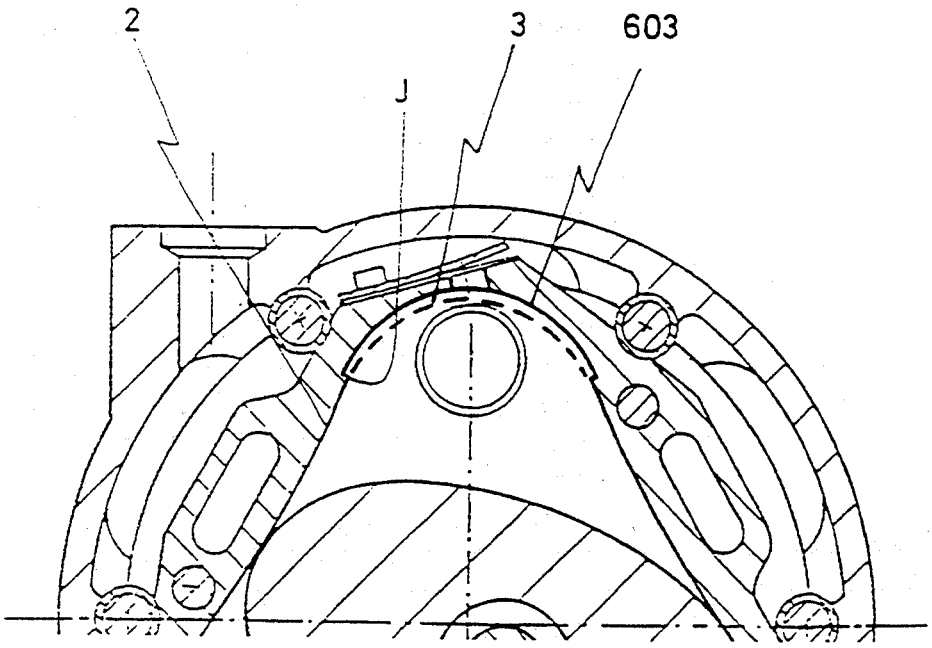

FIG. 27 is a fragmentary section in a machine according to the invention which differs from that shown in FIGS. 25 and 26 only in the lack of physical embodiment of the closure arcs such as 3, which are replaced by arcs such as 603 outside them, since the contact corresponding to the closure point is no longer physical.

Figure 28:
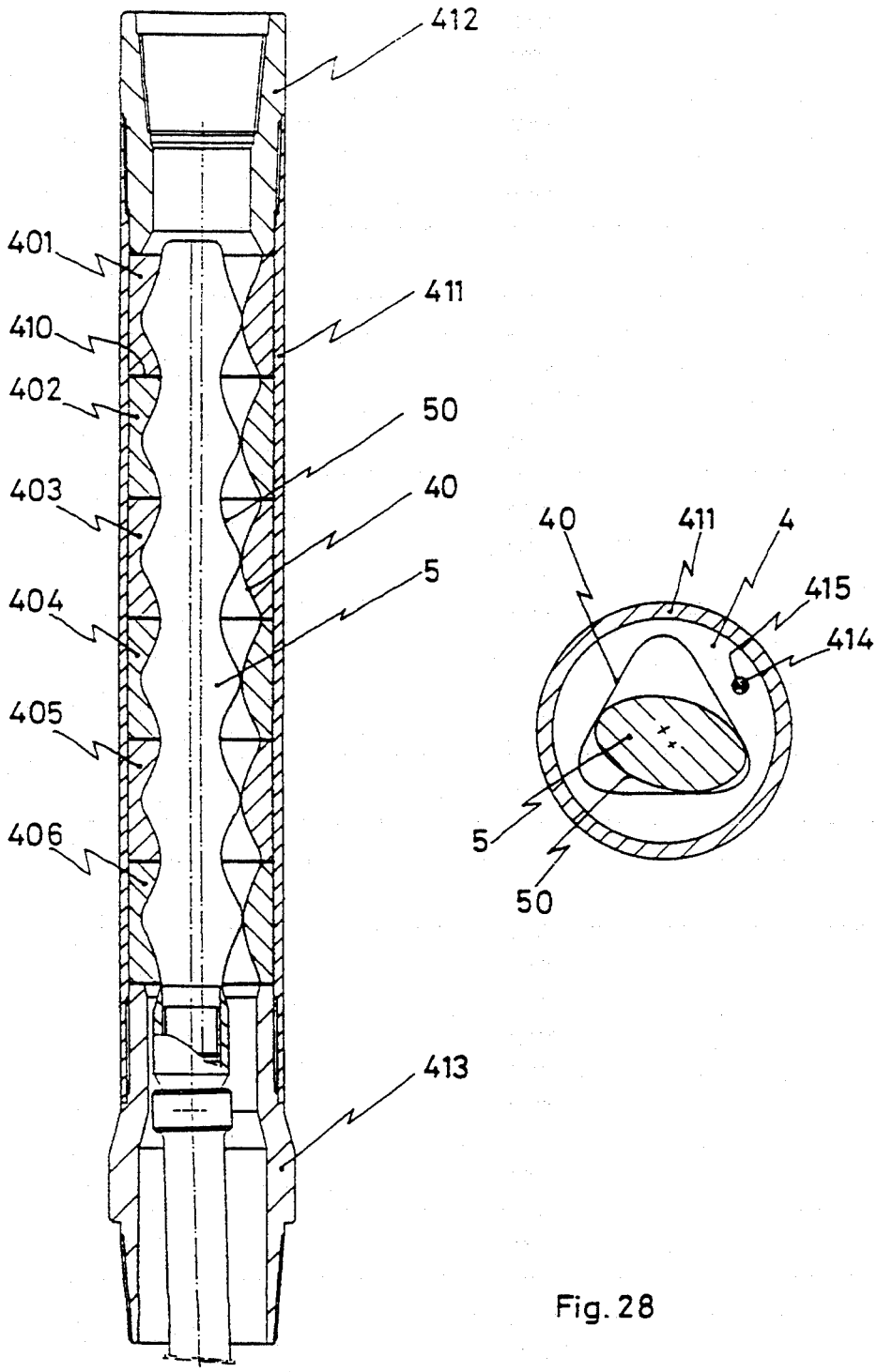

FIG. 28 shows the helicoidal mechanism of another machine according to the invention, where the female surface 40 belonging to the statoric tubular body 4 is physically embodied by a length equal to two pitches $P_f$, and where this tubular body is cut into $6=2(n_m+1)$ identical pieces 401–406. This figure is an axial section of the mechanism supplemented with a cross section in the joining plane 410. The pieces 401–406 are wedged into the tube 411 and are compressed there by the collars 412 and 413 screwed into the threaded ends of this tube 411. Each section is aligned angularly with respect to the adjacent sections via pins such as 414, engaging the bores such as 415 opening into the joining planes such as 410. Finally, the male organ 5 and the helicoidal male profile surface 50 can be seen in this figure.

While this invention has been described in conjunction with specific embodiments thereof, it is evident that many alternatives, modifications and variations will be apparent to those skilled in the art. Accordingly, the preferred embodiments of the invention, as set forth herein, are intended to be illustrative, not limiting. Various changes may be made without departing from the spirit and scope of the invention as described herein and defined in the following claims.

What is claimed is:

1. A rotary positive displacement machine comprising:

a male organ;

a female organ surrounding said male organ, an outer surface of the male organ defining a male surface and an inner surface of the female organ defining a female surface, said male and female surfaces defining, by evolution of linear contacts of said male and female surfaces and displacement, a work chamber, said male and female surfaces being helicoidal surfaces having parallel axes spaced apart by a length E, said surfaces being further defined about said axes by a nominal profile in a cross section of the mechanism and by a pitch $P_f$ of the female surface and a pitch $P_m$ of the male surface;

a profile of the male surface defining a male profile, said male profile having an order of symmetry $n_m$ with respect to a center $O_m$ of said male profile and a symmetry with respect to an axis originating at $O_m$ and passing through extreme polar radius points of said male profile;

a profile of the female surface defining a female profile, said female profile having an order of symmetry $n_m+1$ about a center $O_f$ of said female profile;

a ratio of the pitch $P_f$ of the female surface to the pitch $P_m$ of the male surface is equal to $$\frac{n_m+1}{n_m};$$

said male profile being inscribed in a circular ring having a center $O_m$ a half-width E and a mean radius $R^\circ_m$, defining a ring containing the male profile said mean radius determining a scale of cross sections of the mechanism;

said female profile being inscribed in a circular ring having a center $O_f$, a half-width E and a mean radius $R^\circ_m+E$, defining a ring containing the female profile;

said male organ being in relative planetary motion with respect to the female organ, a first rotation comprising said planetary motion driving an axis of said male surface to define, at a predetermined speed $\omega$ about an axis of the female surface, a cylinder of revolution said cylinder having a radius E, and a second rotation comprising said planetary motion driving the male organ in rotation about the axis of said male organ at a speed $$\frac{(-\omega)}{n_m};$$

wherein the male profile is such that, between two successive extreme polar radii of said male profile, a running point U traversing said male profile from a point of maximum polar radius $R_{max}$ to a point of minimum polar radius $R_{min}$, passes via a fixed point A on the male profile, a polar radius $R_{A0}$ of said male profile, a first derivative $R_{A1}$ thereof with respect to the polar angle and a second derivative $R_{A2}$ thereof with respect to the polar angle satisfy equations:

$$n_m E = R_{A0} \cdot \sin(\arctan(-R_{A1}/R_{A0})) \text{ and}$$

$$R_{A2}/R_{A0} = -(R_{A1}/R_{A0})^4, \text{ where } R_{max}-R_{min}=2E$$

simultaneously;

a nominal female profile being defined by a complete physically embodiable outer envelope of the male profile in relative planetary motion;

wherein in addition to having $n_m+1$ permanently existing points of contact between said male and female profiles on $n_m+1$ disconnected arcs of the female profile traveling in reciprocating motion, for certain predetermined configurations, there is an additional point of contact defining a closure point said closure point being defined in a single direction and successively traversing on the male profile at all segments, and on the female profile in said single direction and successively on $n_m+1$ separate arcs, said $n_m+1$ separate arcs joining each other tangentially with said $n_m+1$ disconnected arcs of the female profile; and said work chambers of said machine are closed such that said male and female surfaces defining the chambers contain a single point defining a tapered closure in a section where a closure point comes into contact with said $n_m+1$ permanently existing points of contact.

2. The rotary positive displacement machine of claim 1, wherein the male profile (1) is a hypertrochoid having an equation which, in the complex plane $O_mXY$ where $O_mX$ is carried by a half-axis of symmetry of the male profile where a polar radius of said male profile is maximal, is written as follows:

$$Z_U=X_U+iY_U=R^\circ_m \exp i(\kappa)+E(1+(k/2)(n_m-1)) \exp i((1-n_m)\kappa)-kE((\tfrac{1}{2})(n_m-1)) \exp i((1+n_m)\kappa) \quad (I)$$

wherein, expi represents the imaginary exponential function, the angle $\kappa$ is a configuration parameter relative to the running point U, $n_m$ is greater than 1, and $k=1$, where $E/R^\circ_m \leqq 1/(n_m^2-1)$, and $k=0$, where $E/R^\circ_m < 1/(n_m-1)$.

3. The rotary positive displacement machine of claim 2, wherein the male profile (1) and the female profile (23) are curves at a uniform distance (D) from the male and female profiles defined by the equations where $k=0$, forming a fictitious mechanism where a center distance of the axes is E, E being a center distance of a real mechanism, where the ring containing the male profile has a mean radius equal to $R^\circ_m-D$, and where the ring containing the female profile has a mean radius equal $R^\circ_m+E-D$, the distance D being counted positively in a centrifugal direction, and any curve at a negative distance D from the profiles forming the fictitious mechanism being retained only if said curve has no double point.

4. The rotary positive displacement machine of claim 1, wherein the male profile (1) is defined as an internal envelope of a half-driving arc (2) of the female profile (23) having ends (M and J), constructed such that M is at a distance $R^\circ_m$ from the center $O_f$, a normal $g_M$ to the half-driving arc at M passing through $O_f$ and intersecting a circumference $C_{pf}$ centered on $O_f$ and having a radius $(n_m+1)E$ at two diametrically opposed points $M_1$ and $M_2$, on the condition that $R^\circ_m$ is greater than $(n_m-1)E$, and that the angle (M $O_f$ J) is less than $2\pi/(n_m+1)$, J is at a distance $R_J$, $R_J$ being greater than $R^\circ_m$, from the center $O_f$ and a normal $g_J$ to the half-driving arc at J is tangent to the circumference $C_{pf}$ at the point $J_1$ coinciding with the point $J_2$, and for any point C located between M and J, a normal $g_C$ to a half-driving arc intersects the circumference $C_{pf}$ at two points $C_1$ and $C_2$, the point $C_1$ being displaced from $M_1$ to $J_1$ and the point $C_2$ being displaced from $M_2$ to $J_2$ when C traverses the segment MJ, the half-driving arc being freely selected.

5. The rotary positive displacement machine of claim 4, wherein the male surface (50) and female surface (40) degenerate into cylindrical surfaces and are defined by the male and female profiles, respectively (1 and 23); the work chambers are axially closed by flanges (503 and 504); and a fluid may be admitted radially into the cylindrical mechanism and may escape in the same manner (509 and 510), the driving arcs (2) enveloping a hypertrochoid (1) being excluded.

6. The rotary positive displacement machine of claim 5, wherein the closure arcs (3) are replaced by arcs (603) which are outside said closure arcs, a corresponding contact at the closure point no longer being physical.

7. The rotary positive displacement machine of claim 1, wherein the tubular body (4) is made of a plurality of identical pieces (401-406) having small lengthening, defined by planes perpendicular to the axis (410), aligned and assembled (414 and 415) to constitute a single device.

* * * * *